US006112038A

United States Patent [19]

Takahata

[11] Patent Number: 6,112,038

[45] Date of Patent: Aug. 29, 2000

[54] IMAGE FORMING APPARATUS HAVING A STABLE POTENTIAL AT A FIRST TRANSFER POINT

[75] Inventor: Toshiya Takahata, Nagano, Japan

[73] Assignee: Seiko Epson Corporation, Tokyo, Japan

[21] Appl. No.: 09/357,392

[22] Filed: Jul. 20, 1999

[30] Foreign Application Priority Data

Jul. 21, 1998 [JP] Japan ..... 10-221027

[51] Int. Cl.[7] ..... G03G 15/00

[52] U.S. Cl. ..... 399/66; 399/398; 399/302

[58] Field of Search ..... 399/66, 298, 302, 399/303

[56] References Cited

U.S. PATENT DOCUMENTS 5,809,387 9/1998 Takeuchi et al. ..... 399/302
5,946,538 8/1999 Takeuchi et al. ..... 399/302
5,953,572 9/1999 Takeuchi et al. ..... 399/302
6,026,269 2/2000 Setoriyama ..... 399/302

*Primary Examiner*—William J. Royer
*Attorney, Agent, or Firm*—Sughrue, Mion, Zinn, Macpeak & Seas, PLLC

[57] ABSTRACT

An intermediate transfer member is constituted by a composite layer member that includes a conductive layer and a resistance layer, which is integrally formed on the conductive layer and to which the visible image is transferred. When a peripheral speed of the intermediate transfer member is defined as Vp (mm/s), the resistance of the resistance layer is defined as Rit and the resistance of the second transfer member is defined as Rt2, the following condition is satisfied:

$$1\times10^{11}/Vp \geqq Rit+Rt2 \geqq 1\times10^{9}/Vp.$$

1 Claim, 4 Drawing Sheets

IMAGE FORMING APPARATUS HAVING A STABLE POTENTIAL AT A FIRST TRANSFER POINT

BACKGROUND OF THE INVENTION

1. Field of the Invention

The present invention relates to an image forming apparatus, such as a printer, a facsimile or a copier, that forms an image using electrophotography. In particular, the present invention pertains to an image forming apparatus that includes an intermediate transfer member to which an image is first transferred from a latent image bearing member, such as a photosensitive member, and from which the image is later transferred to a recording medium.

2. Description of the Related Art

Generally, an image forming apparatus that employs electrophotography comprises: a photosensitive member, which serves as a latent image bearing unit, having a photosensitive layer on an external surface; charging means, for uniformly electrifying the external surface of the photosensitive member; exposure means, for selectively exposing the external surface that is uniformly charged by the charging means and for forming an electrostatic latent image on the external surface; developing means, for applying charged toner, as a developing agent, to the electrostatic latent image formed by the exposure means so as to provide a visible image (a toner image); and a transfer device, for transferring the toner image developed by the developing means to a recording medium, such as paper.

A well known transfer device for transferring the toner image developed on the photosensitive member to a recording medium, such as paper, is one that includes an intermediate transfer member to which the toner image formed on the photosensitive member is transferred (first transfer), and from which the toner image is transferred to a recording medium (second transfer).

Shown in FIGS. 4A and 4B is an example image of an forming apparatus that includes such an intermediate transfer member: FIG. 4A is a schematic perspective view and FIG. 4B is a cross-sectional view taken along line b—b in FIG. 4A.

In FIGS. 4A and 4B, formed on a photosensitive member 1 is a conductive layer 1*a* and a photosensitive layer 1*b*. The conductive layer 1*a* is grounded.

An intermediate transfer member 2 is constituted by a dielectric member (middle resistance layer) having a resistance of, for example, $10^7$ to $10^{14}$ Ω cm. The intermediate transfer member 2 can be fabricated by mixing conductive carbon with synthetic resin.

The intermediate transfer member 2 contacts the photosensitive member 1, at least during the image forming process, with contact point T1 serving as the first transfer point. At the first transfer point T1, a first transfer roller 3, which is located inside the intermediate transfer member 2, applies a first transfer voltage to an intermediate transfer member 2.

A second transfer roller 4, for applying a second transfer voltage, is pressed against the intermediate transfer member 2, and the point at which pressure is applied serves as a second transfer point T2. At the second transfer point T2, a backup roller 5 is located inside the intermediate transfer member 2.

In the image forming process, first, the photosensitive member 1 and the intermediate transfer member 2 are rotated, the photosensitive layer 1*b* of the photosensitive member 1 is uniformly electrified by charging means (not shown), and the photosensitive member is selectively exposed by exposure means (not shown) to form an electrostatic latent image. Then, a developing agent, toner, is applied to the electrostatic latent image by developing means (not shown) and a visible image (a toner image) is formed. Thereafter, at the first transfer point T1, the toner image is transferred to the intermediate transfer member 2, and at the second transfer point T2, the toner image is transferred to a recording medium, such as paper, that is fed to the second transfer point T2.

A recording medium to which the toner image has been transferred is passed through a fixing unit (not shown) and the toner image is fixed to the recording medium.

The intermediate transfer member 2 of the above described conventional image forming apparatus has a single layer structure obtained by mixing conductive particles, such as conductive carbon, with synthetic resin. Since uniform distribution of the conductive particles is not easy, the resistance value tends to vary.

Therefore, the electric field of the transfer member tends to vary, and as a result, uneven image transfers tend to occur.

In addition, since a local projection tends to be formed on the surface of the intermediate transfer member due to an agglomeration of the gel element in the resin or of the conductive particles, the contact of the photosensitive member and the intermediate transfer member, or the contact of the intermediate transfer member and the roller located on the reverse face, is locally unstable, and again, uneven image transfers tend to occur.

In order to solve the above-mentioned problems, there is an image forming apparatus as a related art for the transfer of a visible image to the intermediate transfer member at the first step, and for the transfer of the visible image to a recording medium at the second step. It is desirable for such an image forming apparatus to improve its throughput in such a way that the first transfer and the second transfer be performed at the same time accordingly.

In the arrangement wherein the intermediate transfer member is so designed that the resistance layer is integrally formed on the conductive layer, however, when the second transfer is performed during the performance of the first transfer such as a situation that the on/off state of the second transfer voltage are changed during said period, it has been found that the potential at the first transfer portion becomes unstable and spikes, and image noise is generated.

SUMMARY OF THE INVENTION

It is an object of this invention, even when the amount of toner (the thickness of a layer), the environment and the resistance of each member are varied, an image can be preferably transferred and the second transfer roller 38 can be preferably cleaned.

It is a further object of this invention, since the resistance of the intermediate transfer belt 36 and the depth (the depth) to which it is pressed against the photosensitive member 10 are set within the above range, the first transfer can be performed at a comparatively low voltage (one equal to or less than 1200 V).

It is yet another object of this invention, since the first transfer bias voltage is applied in the above described manner, deterioration of an image, which is caused by interference during the simultaneous performance of the first and the second transfer, can be prevented.

It is yet another object of this invention, with the resistance of the intermediate transfer belt 36 and the second transfer point T2, image noise caused by a spike can be prevented. In addition, even when the paper type, the environment and the resistance of each member are varied, the second transfer can be preferably performed at a voltage that is equal to or less than 4000 V and 300 $\mu$A. Further, the second transfer roller 38 can be preferably cleaned.

It is yet another object of this invention, the preferable image transfer can also be performed for rough paper, such as nina bond paper, in accordance with the second transfer roller 38, the toner and the amount of toner deposited before the second transfer. Furthermore, when the surface of paper is deformed because a heavy load is placed on the hard second transfer roller 38, the dispersion of toner due to the discharge can be limited, even if a high powered electric field is formed by increasing the amount of the additive in the toner. Further, the toner transfer efficiency can be enhanced by reducing the amount of toner before the second transfer, as described above. In addition, the paper feeding state is stabilized because of the heavy load imposed on the second transfer roller 38, and the second transfer roller 38 can be preferably cleaned.

It is yet another object of this invention, the intermediate transfer belt 36 is pressed against the photosensitive member 10 by its own tension without a transfer roller being employed to push the belt against the photosensitive member (as it were, the side abutting structure), the intermediate transfer belt 36 contains fluorine particles, and high flowability is provided for the toner. As a result, at the first transfer a so-called transfer hollow phenomenon can be prevented.

It is yet another object of this invention, since the intermediate transfer belt 36 contains fluorine particles and the toner has the above described high flowability, a so-called transfer hollow phenomenon at the second transfer can be prevented, even though the second transfer roller 38 is hard and a heavy load is imposed on it.

It is yet another object of this invention, because of the composition of the toner, the resistance value of the intermediate transfer belt 36 and the surface roughness, the toner attached to the intermediate transfer belt 36 is stably conveyed, and dispersion of toner at the second transfer point T2 can be reduced.

DESCRIPTION OF THE PREFERRED EMBODIMENTS

One embodiment of the present invention will now be described while referring to the accompanying drawings.

Figure 1:
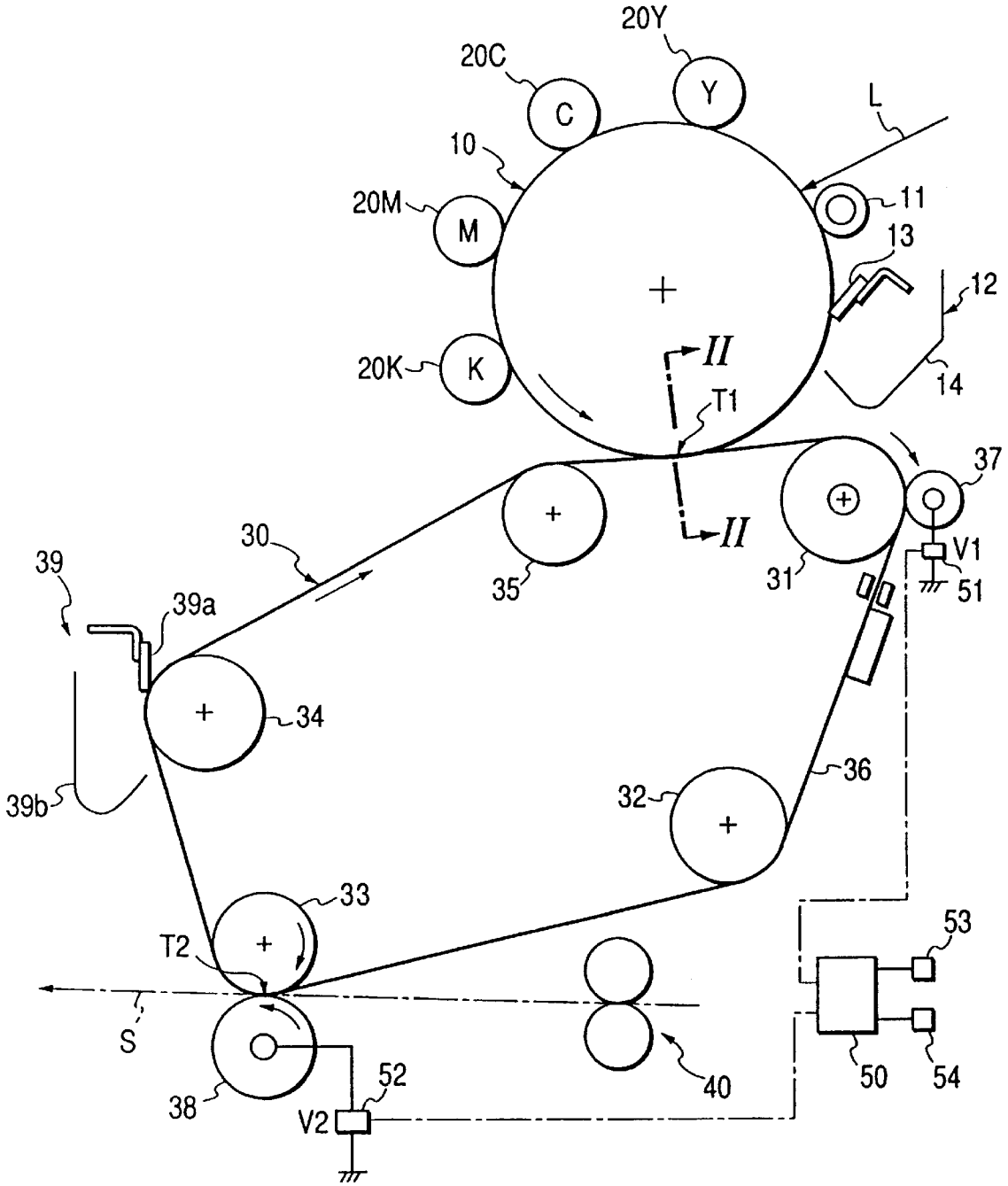
FIG. 1 shows a specific diagram illustrating the essential portion of an image forming apparatus according to one embodiment of the present invention.
Figure 2:
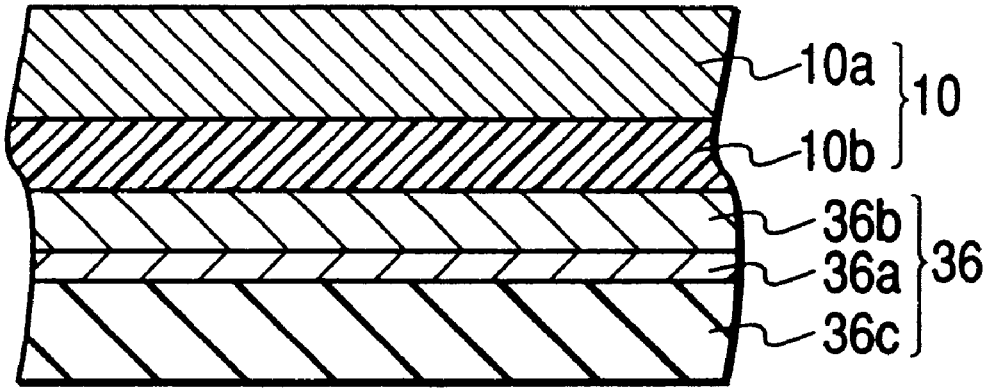
FIG. 2 shows an enlarged cross-sectional view taken along line II—II in FIG. 1.

FIG. 1 is a specific diagram illustrating the essential portion of an image forming apparatus according to an embodiment of the present invention, and FIG. 2 is an enlarged cross-sectional view taken along line II—II in FIG. 1.

The image forming apparatus employs a developing unit of four color toners, for yellow, cyan, magenta and black, to form a full-color image.

In FIG. 1, a photosensitive member 10, which serves as a latent image bearing member, is rotated by appropriate drive means (not shown) in the direction indicated by an arrow.

A charge roller 11, which acts as charging means; developing rollers 20 (Y, C, M and K), which act as developing means; an intermediate transfer unit 30; and cleaning means 12 are located on the periphery of the photosensitive member 10 in the rotational direction.

The photosensitive member 10 includes a cylindrical conductive member 10*a* (see FIG. 2) on which is formed a photosensitive layer 10*b*.

The charge roller 11 contacts the external surface of the photosensitive member 10 and uniformly electrifies it at −600 V, for example.

The external surface of the photosensitive member 10, which is uniformly charged, is selectively exposed to light L by an exposing unit (not shown) in accordance with desired image information. The potential of the portion that is exposed to light L is reduced to approximately −100 V, for example, and an electrostatic latent image is formed thereat.

The electrostatic latent image is developed into a visible toner image by the application of toner by the developing rollers 20 (Y, C, M and K). Since a development bias is applied to the developing rollers 20, toner having a negative polarity charge is attached to the portion whereat the potential has been reduced to develop the visible toner image.

In this embodiment, a developing roller 20Y for yellow, a developing roller 20C for cyan, a developing roller 20M for magenta, and a developing roller 20K for black are provided. The developing rollers 20Y, 20C, 20M and 20K can selectively contact the photosensitive member 10, and while in contact with the photosensitive member 10 can apply yellow, cyan, magenta and black toner to the surface of the photosensitive member 10 to develop the electrostatic latent image on the photosensitive member 10.

The obtained toner image is first transferred to an intermediate transfer belt 36, which will be described later.

The cleaning means 12 includes a cleaner blade 13 for scraping off residual toner that is attached to the external surface of the photosensitive member 10 after the transfer process, and a reservoir 14 in which toner scraped off by the cleaner blade 13 is retained.

The intermediate transfer unit 30 includes a drive roller 31, four follow-up rollers 32, 33, 34 and 35, and the endless intermediate transfer belt 36 that is fitted around these rollers. In this embodiment, the intermediate transfer belt 36 serves as an intermediate transfer member.

The drive roller 31 is rotated at substantially the same peripheral speed as that of the photosensitive member 10 by using a gear (not shown) fixed to the end of the drive roller 31 to engage a driving gear (not shown) of the photosensitive member 10. As a result, the intermediate transfer belt 36 is rotationally fed in the direction indicated by an arrow at substantially the same peripheral speed as that of the photosensitive member 10.

The follow-up roller 35 is located at a position at which, with a force produced by tension, the intermediate transfer belt 36 is pressed against the photosensitive member 10 in the interval between the follow-up roller 35 and the drive roller 31, and the first transfer point T1 is provided at the portion where the intermediate transfer belt 36 contacts the photosensitive member 10. The follow-up roller 35 is located near the first transfer point T1, upstream, in the feeding direction of the intermediate transfer belt 36.

An electrode roller 37 is located opposite the drive roller 31 via the intermediate transfer belt 36, and a first transfer voltage V1 of, for example, +500 V provided by a constant voltage power source 51 is applied through the electrode roller 37 to a conductive layer 36*a* of the intermediate transfer belt 36 that will be described later.

The follow-up roller 32 is a tension roller that employs urging means (not shown) to force the intermediate transfer belt 36 in the direction of the tension.

The follow-up roller 33 is a backup roller for forming the second transfer point T2. A second transfer roller 38 is positioned opposite the backup roller 33, via the intermediate transfer belt 36, as a second transfer member. The second transfer roller 38 can be separated from the intermediate transfer belt 36 by a separation mechanism (not shown).

A power supply device 52 is connected as voltage application means to the second transfer roller 38. In the second transfer process, which will be described later, the power supply device 52 applies to the second transfer roller 38 a second transfer voltage V2 (e.g., +1000 V) that has the same polarity as the first transfer voltage V1 but that has a greater absolute value than has the first transfer voltage V1. At a specific time, at least when the second transfer, which will be described later, is not being performed, the power supply device 52 halts the application of a voltage to the second transfer roller 38 while applying the first transfer voltage V1 to the intermediate transfer belt 36, i.e., the power supply device 52 halts the application of the second transfer voltage V2. The power supply device 52 is a power source of a current sink type.

The follow-up roller 34 is a backup roller for a belt cleaner 39. The belt cleaner 39 includes a cleaner blade 39*a*, which contacts the intermediate transfer belt 36 and scrapes off residual toner that is attached to the external surface of the belt 36, and a reservoir 39*b*, which is used to retain the toner scraped off by the cleaner blade 39*a*. The belt cleaner 39 can be separated from the intermediate transfer belt 36 by a separation mechanism (not shown).

As is shown in FIG. 2, the intermediate transfer belt 36 is a composite layer belt including a conductive layer 36*a* and a resistance layer 36*b*, which is integrally formed with the conductive layer 36*a* and which is pressed against the photosensitive member 10. In this embodiment, the conductive layer 36*a* is integrally formed with an insulating base member 36*c* made of synthetic resin, and the first transfer voltage V1 is applied to the conductive layer 36*a* via the previously described electrode roller 37. The resistance layer 36*b*, is exposed by removing a corresponding portion along the side edge of the belt 36 so that the electrode roller 37 contacts the exposed portion.

During the circulation of the intermediate transfer belt 36, the toner image on the photosensitive member 10 is transferred to the intermediate transfer belt 36 at the first transfer point T1, and the toner image on the intermediate transfer belt 36 is then transferred to a recording medium S, such as paper, that is fed between the belt 36 and the second transfer roller 38 at the second transfer point T2. The recording medium S is fed by a paper feeding device (not shown), and is conveyed by a gate roller pair 40 to the second transfer point T2 at a predetermined timing.

In FIG. 1, connected to a controller 50, which controls the entire operation of the image forming apparatus, is a temperature sensor 53 and a humidity sensor 54. The controller 50 can be so designed that the first transfer voltage V1 and the second transfer voltage V2 are determined as needed in accordance with the temperature and humidity detected by the sensors 53 and 54.

The image forming apparatus in this embodiment is so designed that when the peripheral speed of the intermediate transfer belt 36 is defined as Vp (mm/s), the resistance of the resistance layer 36*b* is defined as Rit, and the resistance of the second transfer roller 38 is defined as Rt2, the following condition is satisfied:

$$1\times10^{11}/Vp \geqq Rit+Rt2 \geqq 1\times10^{9}/Vp.$$

The operation of the thus arranged image forming apparatus is as follows.

(i) Upon receiving a print command signal (image forming signal) from a host computer (not shown), the controller 50 of the image forming apparatus rotates the photosensitive member 10, the developing rollers 20 (Y, C, M and K), and the intermediate transfer belt 36.

(ii) The external surface of the photosensitive member 10 is uniformly charged by the charge roller 11.

(iii) The external surface of the photosensitive member 10, which is uniformly charged, is selectively exposed to a light L by an exposure unit (not shown) in accordance with image information for the first color (e.g., yellow), and a yellow electrostatic latent image is formed.

(iv) Only the developing roller 20Y for the first color (e.g., yellow) contacts the photosensitive member 10, the above electrostatic latent image is developed, and a toner image for the first color (e.g., yellow) is formed on the photosensitive member 10.

(v) The first transfer voltage V1 that has a polarity opposite to the charging polarity of the toner is applied to the intermediate transfer belt 36, and the toner image formed on the photosensitive member 10 is transferred to the intermediate transfer belt 36 at the first transfer point, i.e., the point T1 at which the photosensitive member 10 presses against the intermediate transfer belt 36. At this time, the second transfer roller 38 and the belt cleaner 39 are separated from the intermediate transfer belt 36.

(vi) The residual toner on the photosensitive member 10 is removed by the cleaning means 12, and the charge on the photosensitive member 10 is eliminated by an elimination light emitted by charge elimination means (not shown).

(vii) Steps (ii) to (vi) are repeated as needed. That is, in accordance with the contents of the print command signal, the processing is repeated for the second, the third and the fourth color, and toner images that are consonant with the contents of the print command signal are superimposed on the intermediate transfer belt 36.

(viii) The recording medium S is fed at a predetermined timing, and immediately before or after the leading edge of the recording medium reaches the second transfer point T2, i.e., when the toner image on the intermediate transfer belt 36 has been transferred to a desired location relative to the recording medium S, the second transfer roller 38 is pressed against the intermediate transfer belt 36 and the second transfer voltage V2 is applied, so that the toner image (basically a full-color image) on the intermediate transfer belt 36 is transferred to the recording medium S.

When the second transfer has been completed, the application of the second transfer voltage V2 to the second transfer roller 38 is halted at an appropriate timing (or a voltage is applied that has the same polarity as the first transfer voltage V1 and that has a smaller absolute value than has the first transfer voltage V1), while the second transfer roller 38 is pressed against the intermediate transfer belt 36 and the first transfer voltage V1 is applied to the intermediate transfer belt 36. As a result, a potential difference (e.g., about +500 V) is applied between the second transfer roller 38 and the intermediate transfer belt 36. Because of this difference, the toner attached to the second transfer roller 38 is transferred to the intermediate transfer belt 36, so that the second transfer roller 38 is cleaned. The toner transferred to the intermediate transfer 36, together with the toner that remains on the intermediate transfer belt 36 after the second transfer, is removed when the belt cleaner 39 is brought into contact with the intermediate transfer belt 36.

The toner image is fixed to the recording medium S by passing the recording medium S through a fixing unit (not shown), and the recording medium S is then discharged outside the apparatus.

The followings are the operations obtained by the above described image forming apparatus.

(a) The image processing apparatus comprises: a rotary photosensitive member 10, on the surface of which an electrostatic latent image is formed; developing rollers 20 (Y, C, M and K), for applying a developing agent to the surface of the photosensitive member 10 to develop the latent image as a toner image; a rotary intermediate transfer belt 36, to which the toner image is first transferred upon the application of the first transfer voltage; and a second transfer roller 38, which is pressed against the intermediate transfer belt 36 via a recording medium S and which performs a second transfer of the toner image to the recording medium S upon the application of a second transfer voltage. Thus, the toner image formed on the surface of the photosensitive member 10 is first transferred to the intermediate transfer belt 36, and the toner image on the intermediate transfer belt 36 is then transferred to the recording medium S.

Since the intermediate transfer belt 36 has a composite layer structure, which includes the conductive layer 36*a* and the resistance layer 36*b*, which is integrally formed on the conductive layer 36*a* and to which the toner image is transferred, the resistance layer 36*b* can be formed by applying a coating of a resin solution wherein conductive particles are dispersed, and solidifying and drying the resin solution. When conductive particles are dispersed in a resin solution wherein a resin is dissolved in a solvent, a more preferable dispersion of conductive particles is obtained than is obtained by mixing conductive particles in a thermally melted resin. Therefore, there is little variation in the resistance of the resistance layer 36*b*. Further, since the conducive particles are preferably dispersed, local projections on the surface of the resistance layer 36*b* rarely occur, and the contact with the photosensitive member 10 can be stabilized to prevent transfer failures.

Furthermore, since the resistance layer 36*b* is integrally formed on the conductive layer 36*a*, upon application of the first transfer voltage V1 to the conductive layer 36*a*, the potential on the reverse face of the resistance layer 36*b* becomes substantially uniform, and a substantially uniform transfer field is formed across the entire transfer area.

Therefore, according to the image forming apparatus in this embodiment, an even electric field at the transfer point is maintained, and as a result, an even image can be appropriately formed.

(b) In order to improve the throughput for the image forming apparatus in this embodiment, i.e., an image forming apparatus for first transferring a toner image to the intermediate transfer belt 36 that is an intermediate transfer member and for then transferring the toner image to a recording medium S, it is desirable that, as needed, the first transfer and the second transfer be performed at the same time. In this embodiment, as is shown in a timing chart which will be described later in FIG. 3, the first transfer of the toner image for the fourth color (K) and the second transfer of the toner image (full-color image) that has been transferred to the intermediate transfer belt 36 are simultaneously performed at a specific time in order to form a full-color image.

In the arrangement where the intermediate transfer belt 36 is so designed that the resistance layer 36*b* is integrally formed with the conductive layer 36*a*, it is found that when the application of the second transfer voltage is performed or halted during the first transfer, the potential at the first transfer portion becomes unstable and spikes, and unless countermeasures are taken, image noise is generated.

According to the image forming apparatus in this embodiment, since the peripheral speed of the intermediate transfer belt 36 is defined as Vp (mm/s), the resistance at the resistance layer 36*b* is defined as Rit, and the resistance at the second transfer roller 38 is defined as Rt2, the following condition is satisfied:

$$1\times10^{11}/Vp \geqq Rit+Rt2 \geqq 1\times10^{9}/Vp.$$

Thus, even though the intermediate transfer belt 36 is arranged as is described above, and even when the application of the second transfer voltage is performed or halted during the first transfer, the potential at the first transfer point can be prevented from being unstable and spiking, and as a result, image noise is not generated.

To obtain Rit+Rt2, when the second transfer voltage V2 is applied while the first transfer voltage V1 is being applied, a current It2 that is provided by the power supply device 52 is measured, and the following equation is calculated $$Rit+Rt2=|V2-V1|/|It2|.$$

(c) Since the power supply device 52 applies, to the second transfer roller 38, the second transfer voltage V2, which has the same polarity as the first transfer voltage V1 and which has a greater absolute value than has the first transfer voltage V1, the visible image can be precisely transferred to the recording medium S (second transfer). And since, at least at a specific time at which the second transfer is not performed, the application of the second transfer voltage V2 to the second transfer roller 38 is performed or halted while the first transfer voltage V1 is applied to the intermediate transfer belt 36 (or a voltage is applied that has the same polarity as the first transfer voltage V1 and that has a smaller absolute value than has the first transfer voltage V1), the potentials of the second transfer roller 38 and the intermediate transfer belt 36 differ. Due to the potential difference, the toner attached to the second transfer roller 38 is transferred to the intermediate transfer belt 36, so that the second transfer roller 38 is cleaned.

Specifically, according to the image forming apparatus in this embodiment, the polarity of a voltage to be applied to the second transfer roller 38 need not be changed to transfer the visible image to the recording medium S and to clean the second transfer roller 38, so that the second cleaning roller 38 can be cleaned without a complicated high voltage power source being required.

In addition, in the arrangement wherein a voltage is not applied to the second transfer roller 38 during the cleaning of the second transfer roller 38, the potential difference between the second transfer roller 38 and the intermediate transfer belt 36 is greater than is that which is caused by the application of a voltage that has the same polarity as the first transfer voltage V1 but that has a smaller absolute value than has the first transfer voltage V1. As a result, the second transfer roller 38 is cleaned better.

(d) The intermediate transfer belt 36 is a composite layer member that includes the conductive layer 36*a* and the resistance layer 36, which is formed on the conductive layer 36*a* and which is pressed against the photosensitive member 10. The potential at the point T2, whereat the intermediate transfer belt 36 is pressed against the second transfer roller 38, is substantially the same as that of the first transfer voltage V1 that is applied via the conductive layer 36*a* to the intermediate transfer belt 36.

Assume that the intermediate transfer member is constituted only by a resistance layer, as in the prior art. The potential at the point T2, whereat the intermediate transfer member is pressed against the second transfer roller 38, is considerably lower than is the first transfer voltage V1 that is applied to the intermediate transfer member. Therefore, the considerably higher, first transfer voltage V1 must be applied to the intermediate transfer member in order to obtain the above described potential difference required for the cleaning of the second transfer roller 38 (i.e., the potential difference between the second transfer roller 38 and the intermediate transfer member when the first transfer voltage V1 is applied to the intermediate transfer member, and when a voltage that has the same polarity as the first transfer voltage V1 but that has a smaller absolute value than the first transfer voltage V1 is applied to the second transfer roller 38, or when no voltage is applied to the second transfer roller 38). If the first transfer voltage V1 is considerably higher, accordingly, the second transfer voltage V2 must also be higher.

Whereas, according to the image forming apparatus in this embodiment, the potential at the point T2, whereat the intermediate transfer belt 36, which is the intermediate transfer member, is pressed against the second transfer roller 38, is substantially the same as the first transfer voltage V1 applied to the intermediate transfer belt 36. Thus, the potential difference required for the cleaning of the second transfer roller 38 can be obtained without too great an increase in the first transfer voltage V1. That is, according to the image forming apparatus in this embodiment, the first transfer voltage V1 that is applied to the intermediate transfer belt 36 is substantially employed to obtain the potential difference required for the cleaning of the second transfer roller 38. As a result, the first and the second transfer voltages V1 and V2 can be reduced.

(e) Since power supply device 52 is of the current sink type, a stable voltage can be maintained, even if a current flows in the reverse direction from that employed in the transfer process, and the potential required for cleaning can be obtained.

A specific example will now be explained.

Application Timings for Various Voltages

Figure 3:
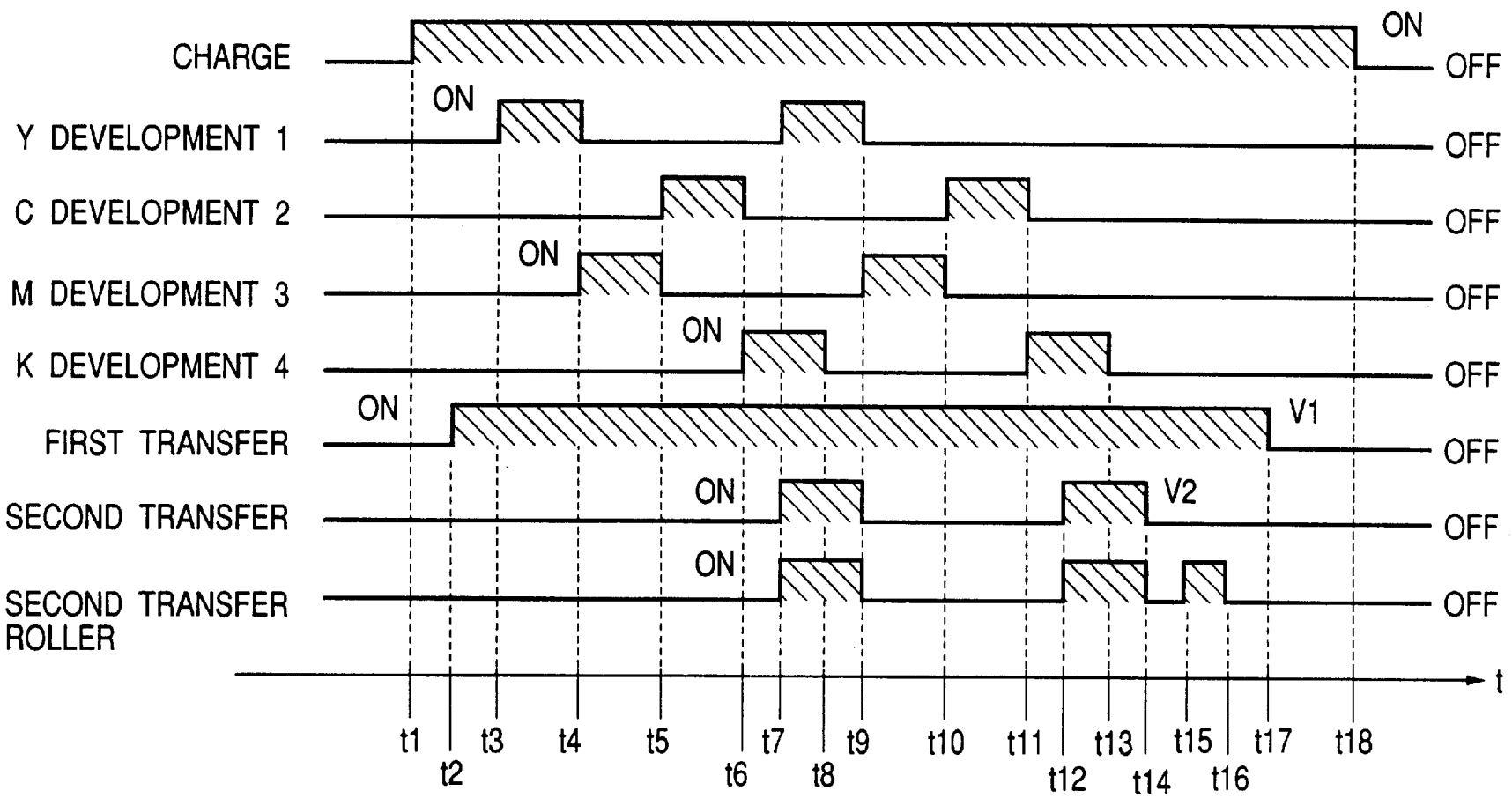
FIG. 3 shows a timing chart showing the application timings for various voltages and the timing for the separation of the second transfer roller 38.
Figure 4A:
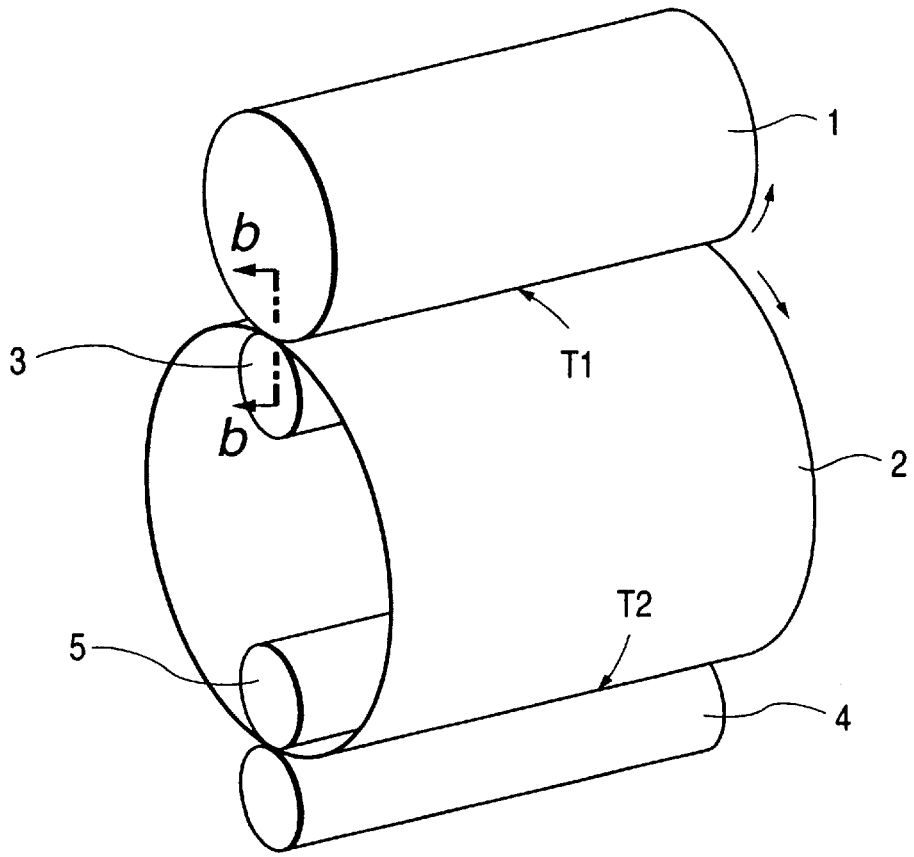
FIG. 4(a) PRIOR ART
FIG. 4A is a perspective view showing a conventional image forming apparatus.
Figure 4B:
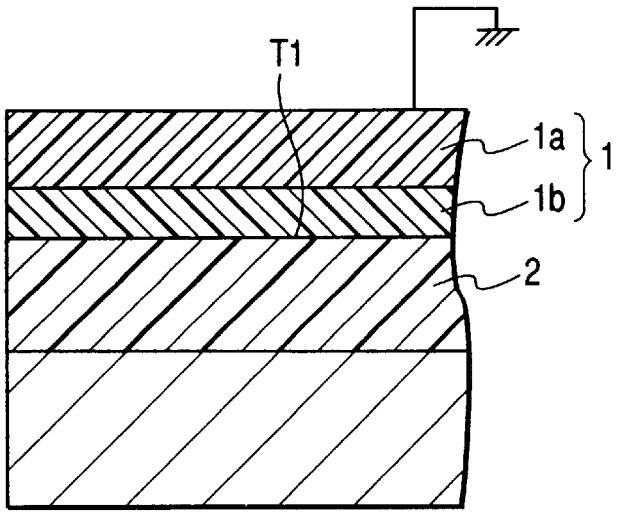
FIG. 4(b) PRIOR ART
FIG. 4B is a cross-sectional view showing a cross-section of a portion of the apparatus taken along line b—b in FIG. 4A.

One example of application timings for various voltages and of separation timing for the second transfer roller 38 is shown in FIG. 3.

FIG. 3 is a timing chart for a process wherein a color image is sequentially transferred to two recording media S, and the second transfer roller 38 is thereafter cleaned.

Specifically, a print command signal (image forming signal) is transmitted by a host computer (personal computer) (not shown) to the controller 50 of the image forming apparatus, which in turn rotates the photosensitive member 10, the developing rollers 20 (Y, C, M and K) and the intermediate transfer belt 36. Then, at predetermined time t1 charging by the charge roller 11 is initiated. Thereafter, the above described exposure using the light L is performed, which is not shown in FIG. 3.

At time t2, the first transfer voltage V1 is applied.

At time t3, the developing roller 20Y for the first recording medium contacts the photosensitive member 10 and the developing bias voltage is applied.

At time t4, the developing roller 20Y is separated from the photosensitive member 10 and the application of the developing bias voltage is halted. At the same time, the developing roller 20M for the first recording medium contacts the photosensitive member 10 and the developing bias voltage is applied.

At time t5, the developing roller 20M is separated from the photosensitive member 10 and the application of the developing bias voltage is halted. At the same time, the developing roller 20C for the first recording medium contacts the photosensitive member 10 and the developing bias voltage is applied.

At time t6, the developing roller 20C is separated from the photosensitive member 10 and the application of the developing bias voltage is halted. At the same time, the developing roller 20K for the first recording medium contacts the photosensitive member 10 and the developing voltage is applied.

At time t7, the second transfer voltage V2 for the first recording medium is applied, and the second transfer roller 38 is pressed against the intermediate transfer belt 36. At substantially the same time, the developing roller 20Y for the second recording medium contacts the photosensitive member 10 and the developing bias voltage is applied.

While the developing for the fourth color (K) is being performed, at time t7 the second transfer voltage V2 is applied. Also as is apparent from FIG. 1, since the distance between the development position for the fourth color (the position of the developing roller 20K) and the first transfer point T1 is comparatively short, the first transfer of the toner image for the fourth color (K) and the second transfer of the toner image (full-color image) that has been transferred to the intermediate transfer belt 36 are simultaneously performed at a specific time.

At time t8, the developing roller 20K is separated from the photosensitive member 10 and the application of the developing bias voltage is halted.

At time t9, the application of the second transfer voltage V2 for the first recording medium is halted, and the second transfer roller 38 is separated from the intermediate transfer belt 36. Substantially at the same time, the developing roller 20Y for the second recording medium is separated from the photosensitive member 10, the application of the developing bias voltage is halted, the developing roller 20M for the second recording medium contacts the photosensitive member 10, and the developing bias voltage is applied.

The time (t9), at which the developing roller 20Y has completed the development of the second recording medium, is substantially the same as the time at which the application of the second transfer voltage V2 is halted. However, since the time at which the first transfer of the toner image formed by the developing roller 20Y is completed is later than time t9, the application of the second transfer voltage is halted for a period during which the toner image formed by the developing roller 20Y is first transferred.

As is described above, in a period extending from time t3 to time t9, the toner images are formed on the photosensitive member 10 in the order Y, M, C and K, and are first transferred to the intermediate transfer belt 36 to form a color image, which is then transferred to the first recording medium S. Also as is apparent from the above description, in a period extending from time t3 to time t7 only the development and the first transfer are performed. In a period extending from time t7 to time t9, as is described above, the development and the first transfer of the final color K, and the collective second transfer of all the colors are performed for the first recording medium, and also the development for the first color Y is performed for the second recording medium.

At time t10, the developing roller 20M for the second recording medium is separated from the photosensitive member 10 and the application of the developing bias voltage is halted. Also, the developing roller 20C for the second recording medium contacts the photosensitive member 10 and the developing bias voltage is applied.

At time t11, the developing roller 20C for the second recording medium is separated from the photosensitive member 10 and the application of the developing bias voltage is halted. At the same time, the developing roller 20K for the second recording medium contacts the photosensitive member 10 and the developing bias voltage is applied.

At time t12, the second transfer voltage V2 for the second recording medium is applied, and the second transfer roller 38 is pressed against the intermediate transfer belt 36.

At time t13, the developing roller 20K for the second recording medium is separated from the photosensitive member 10 and the application of the developing bias voltage is halted.

At time t14, the application of the second transfer voltage V2 for the second recording medium is halted, and the second transfer roller 38 is separated from the intermediate transfer belt 36.

In a period extending from time t15 to time t16, while the first transfer voltage V1 is applied, the second transfer roller 38 is pressed against the intermediate transfer belt 36 without the second transfer voltage V2 being supplied, so that the second transfer roller 38 is cleaned.

As is described above, according to this example, the second transfer roller 38 is cleaned each time an image is transferred to two recording media. In this example, the second transfer roller 38 is cleaned each time images have been transferred to two recording media; however, in a period extending from time t9 to time t12, the second transfer roller 38 may be pressed against the intermediate transfer belt 36 without the second transfer voltage V2 being applied, and the second transfer roller 38 may be cleaned each time an image is transferred to a recording medium.

In order to sequentially transfer an image to three or more recording media, the above described image forming operation for the second recording medium is repeated, i.e., at time t12, the developing roller 20Y for the third recording medium contacts the photosensitive member 10 and the application of the developing bias voltage is begun, and at time t14 the developing roller 20M for the third recording medium contacts the photosensitive member 10 and the application of the developing bias voltage is initiated.

Transfer Voltages V1 and V2

The first transfer voltage is set as a constant voltage of +500 V, and the second transfer voltage V2 is set as a constant voltage of +800 V with a constant current of +30 $\mu$A and a small impedance. The second transfer voltage V2 is not applied to the second tranfer roller 38 during the cleaning. At this time, a current flowing across the intermediate transfer belt 36 and the second transfer roller 38 is set to approximately −10 $\mu$A.

Intermediate Transfer Belt 36

The intermediate transfer belt 36 is formed in the following manner. The insulating base member 36*c* is fabricated from a PET sheet, and the conductive layer 36*a* is formed thereon by AL evaporation. Then, a coat of paint having a thickness of 10 to 100 $\mu$m, wherein fluorine particles and $SnO_2$, which is a conductive agent, are dispersed in urethane as a base material, is applied to the resultant structure, thereby forming the conductive layer 36*a*. Then both ends of the belt shaped conductive layer 36 are bonded together by ultrasonic welding to form an endless belt. Following this, a coat of the paint is applied, except along the side edge of the belt, so that the belt shaped conductive layer 36 is exposed and the electrode roller 37 can contact the exposed portion.

The surface resistivity of the resistance layer 36*b* is approximately $10^8$ to $10^{15}$ Ω/cm, the volume resistivity is approximately $10^7$ to $10^{14}$ Ω cm, and the surface roughness is equal to or less than Rmax1 $\mu$m (more preferably, equal to or less than 0.7 $\mu$m).

First Transfer Point T1

The depth (the thrust depth) to which the photosensitive member 10 is pressed against the intermediate transfer belt 36 is 1.2±0.5 mm.

A current sink constant-voltage source, or a constant-voltage source having a bypass resistor, is employed as a power source. It is preferable that a con*22+* voltage value be determined based on the outputs of the temperature sensor and humidity sensors 53 and 54.

The electrode roller 37 that is employed has a resistance of 1 MΩ or less.

Application of the first transfer bias voltage is halted after the second transfer has been completed.

Second Transfer Point T2

A constant-voltage source is employed to control the lower limit voltage.

The second transfer roller 38 is rendered conductive by an ionic conductive agent. The resistance is $10^6$ to $10^8$ Ω, the hardness is 60±5°, and the pressing load on the backup roller 33 is 5.0 to 9.0 kg (more preferably, about 7.0 kg).

Toner

A high density pigment toner having a particle size of 7 $\mu$m is employed.

For toner, the amount of an additive having a large particle size is 0.5 to 4.0 wt % (more preferably 0.7 wt %), and the amount of an additive having a small particle size is 1.5 to 4.0 wt % (more preferably 2.0 wt %).

The additive having a large particle size is required mainly to improve the durability and stability of the toner. Although more of this additive is better, the amount of the additive should not exceed 4.0 wt %, otherwise the flowability of toner is deteriorated, and transfer hollows and other faults are caused.

The additive having a small particle size is required mainly to improve the transfer of rough paper. Although more of this additive is better, the amount of the additive should not exceed 4.0 wt %, otherwise, due to floating silica, a film tends to be formed on the photosensitive member 10 and the intermediate transfer belt 36.

The flowability of the toner is approximately A.D 0.35 g/cc, and the amount of a charge is $-10\ \mu g/cm^2$ or smaller.

The amount of toner deposited before the second transfer, i.e., the amount of toner on the intermediate transfer belt 36, is $1.5\ mg/cm^2$ or less.

Drive Roller 31

The outer diameter of the drive roller 31 is so set that the peripheral speed of the intermediate transfer belt 36 is slightly higher (including a tolerance) than that of the photosensitive member 10, specifically, 0.6±0.5% higher.

It is preferable that the peripheral speed of the photosensitive member 10 correspond exactly to that of the intermediate transfer belt 36 to which the toner image is transferred from the photosensitive member 10.

However, since a tolerance is provided between the outer diameter of the photosensitive member 10 and that of the drive roller 31, it is impossible to adjust the speeds of these two components so that they match exactly. In this situation, if the peripheral speed of the intermediate transfer belt 36 at the portion whereat it is fitted around the drive roller 31 is slightly less than that of the photosensitive drum, a force for loosening the intermediate transfer belt 36, if it is only a slight force, is applied at the interval between the drive roller 31 and the point (first transfer point T1) whereat the photosensitive member 10 is pressed against the intermediate transfer belt 36. As a result, at the first transfer point T1 the intermediate transfer belt 36 becomes unstable.

In this embodiment, the outer diameter of the drive roller 31 is so set that the peripheral speed of the intermediate transfer belt 36 is slightly higher (within the tolerance) than that of the photosensitive member 10.

With this arrangement, the intermediate transfer belt 36, even though slightly, is held constantly taut at the interval between the drive roller 31 and the position (first transfer point T1) whereat the photosensitive member 10 is pressed against the intermediate transfer belt 36, so that at the first transfer point T1 the state of the intermediate transfer belt 36 is stable.

Urethane is coated on the external surface of the drive roller 31 in order to increase a friction coefficient.

What is claimed is:

1. An image processing apparatus comprising:

a rotary latent image bearing member, on the surface of which an electrostatic latent image is formed;

developing means, for applying a developing agent to said surface of said latent image bearing member to develop said latent image as a visible image;

a rotary intermediate transfer member, to which a first transfer voltage is applied and to which said visible image is transferred first; and a second transfer member, which is pressed against said intermediate transfer member via a recording medium, for performing a second transfer of said visible image to said recording medium upon application of a second transfer voltage, wherein said intermediate transfer member is constituted by a composite layer member that includes a conductive layer and a resistance layer, which is integrally formed on said conductive layer and to which said visible image is transferred, wherein, when the peripheral speed of said intermediate transfer member is defined as Vp (mm/s), the resistance of said resistance layer is defined as Rit and the resistance of said second transfer member is defined as Rt2, the following condition is satisfied:

$$1\times10^{11}/Vp \geqq Rit+Rt2 \geqq 1\times10^{9}/Vp.$$

* * * * *